United States Patent [19]

Schnelle

[11] 4,232,423

[45] Nov. 11, 1980

[54] FURNITURE HINGE

[76] Inventor: Manfred Schnelle, D-4901 Hiddenhausen 2, Am Reesberg 22, Fed. Rep. of Germany

[21] Appl. No.: 931,553

[22] Filed: Aug. 7, 1978

[30] Foreign Application Priority Data

Aug. 9, 1977 [DE] Fed. Rep. of Germany ..... 2735825

[51] Int. Cl.[2] ..... E05D 7/04

[52] U.S. Cl. ..... 16/130; 16/131; 16/132

[58] Field of Search ..... 16/130, 131, 132, 133, 16/171

[56] References Cited

U.S. PATENT DOCUMENTS

| | | | |
|---|---|---|---|
| 3,592,354 | 7/1971 | Nielsen | 16/171 X |
| 3,772,735 | 11/1973 | Lautenschlaeger | 16/130 X |
| 3,774,345 | 11/1973 | Cole et al. | 16/130 X |
| 3,936,907 | 2/1976 | Jansons | 16/171 |
| 3,977,042 | 8/1976 | Lautenschlaeger | 16/130 |
| 4,099,293 | 7/1978 | Pittasch | 16/171 X |

FOREIGN PATENT DOCUMENTS

| | | | |
|---|---|---|---|
| 2458566 | 7/1975 | Fed. Rep. of Germany | 16/131 |

*Primary Examiner*—Wm. Carter Reynolds
*Attorney, Agent, or Firm*—Bacon & Thomas

[57] ABSTRACT

The invention relates to a furniture hinge with hinge arm with at least one pivoting axis. The hinge arm can be fastened by means of a base or adjusting plate on a furniture side wall so that the hinge arm can be adjusted along three axes. The base plate consists of a cup shaped anchoring part inserted into a bore in the furniture side wall and an intermediate support which is fastened on the end face of the anchoring part which remains visible after the insertion of the anchoring part. The anchoring part and the intermediate support are connected to each other by at least one spring loaded ratchet element which engages behind a ratchet step and the ratchet element consists of at least one first wall section with a ratchet nose which projects in the direction of the pivot axis as well as at right angles to the end face. A wedge member locks the anchoring part and intermediate support into a disassembleable assembly.

15 Claims, 11 Drawing Figures

25
B
35
L
32
33
34
4
22
36
21
36
36
36
A
3"
Q
24
3
19
3'
18'
15'
16'
17'
17
16
15
18
23
29
28
27"
30
27
27'
28
2'
11'
39
8
7
11
12
2
6
2"
3
24
3"
15'
18'
16'
31
17
16
15
8
2
2'
11'
39
12
9
9'
26'
13
38
14
26
11

FURNITURE HINGE

BACKGROUND OF THE INVENTION

It is usual nowadays to fasten hinge arms with one or more axes indirectly by means of a base or adjusting plate on a furniture component. In the case of furniture doors, this permits among other things, the possibility of adjustment of the hinge arm for compensating production tolerances in making of the hinge or furniture.

A large number of variants of base or adjusting plates are known. It is also known that a base or adjusting plate can be made in two parts, in which one part consists of a cup shaped anchoring part to be fastened into a bore on the inner surface of a furniture side wall, the said anchoring part having openings on its end face which become visible after the anchoring, into which ratchet flexible projections provided on the second part of the base or adjusting plate, whence it is possible to fasten the hinge arm, preassembled with this second part used as an intermediate support, with few manual operations in a simple manner and conveniently on the anchoring part preassembled on the furniture side wall. The furniture hinge of the prior art does not permit adjustment of the hinge arm parallel to the hinge axis and parallel to the pivot axis of the hinge.

SUMMARY OF THE INVENTION

The present invention retains the convenience of anchoring a preassembled hinge arm into a furniture wall while adding the ability to adjust the hinge arm along two or more axes.

For the solution of this problem, a furniture hinge of the above described kind according to the invention is designed so that the width of the first wall section in the direction of the pivot axis is smaller than the length of the ratchet step in this direction, and that means are provided to clamp the intermediate support on the anchoring part.

This arrangement ensures with simple design of the hinge components a rapid and convenient locking of the intermediate support, or of the hinge arm held on the intermediate support, on the anchoring part in which the hinge according to the invention ensures the additional advantage that the intermediate support as well as the anchoring part can be made integrally of economically produced injection moulded components from plastics.

In a preferred embodiment of the hinge according to the invention there is provided, in addition to the first wall section, a second wall section arranged parallel to the first wall section which latter has no ratchet nose. The first and second wall section, which are alternatively on the intermediate support or on the anchoring part, engage with a common opening of the anchoring part or of the intermediate support. An edge line, which projects in the direction of the pivot axis and which is adjacent to the first wall section, forms the ratchet step or recess for the ratchet nose and the second, longitudinal edge adjacent to the second wall section, is used as a guide for this second wall section. Hence preferably two pairs, consisting of a first and a second wall section are provided. Each pair projects into an opening when the intermediate support is held on the anchoring part. The use of the second wall sections without ratchet noses permits good play free guidance between the two components. Good guidance is aided if the second wall sections rest as flexible spring elements against the adjacent longitudinal edges of the openings. In addition to the above the use of a first wall section provided with a ratchet nose and of a second wall section without the ratchet nose has the advantage that the common opening accommodating both wall sections can be arranged to be very narrow especially in the direction at right angles to the surfaces of the wall sections. Therefore, the opening does not require excessively large space in this anchoring part or the intermediate support even when the anchoring part or intermediate component is small. Hence the small holes do not adversely affect the mechanical strength of the component. The second wall sections are used also in the hinge according to the invention to accommodate to the greatest possible extent external forces acting on the intermediate support, which can cause deformation of the first wall section or of the first wall sections resulting in releasing of the ratchet nose, and to keep these forces away from the first wall sections.

The means for clamping are formed in the hinge according to the invention, preferably by at least one third wall section which has no ratchet nose, in which this wall section is pushed to one side by an expanding element and which is pressed by elastic deformation against a clamping surface which latter is formed preferably by the truncated conical shaped diverging end of an opening. This means for clamping ensures not only an extremely effective anchoring between the intermediate support and the anchoring part, but the use of this third wall section on which no ratchet noses or other recess features are provided, reduces manufacturing complexity by eliminating the sliding parts which would otherwise be required to produce the recesses.

BRIEF DESCRIPTION OF THE DRAWINGS

The invention is explained by means of Figures of an embodiment example in which.

Figures 1, 2, 3:
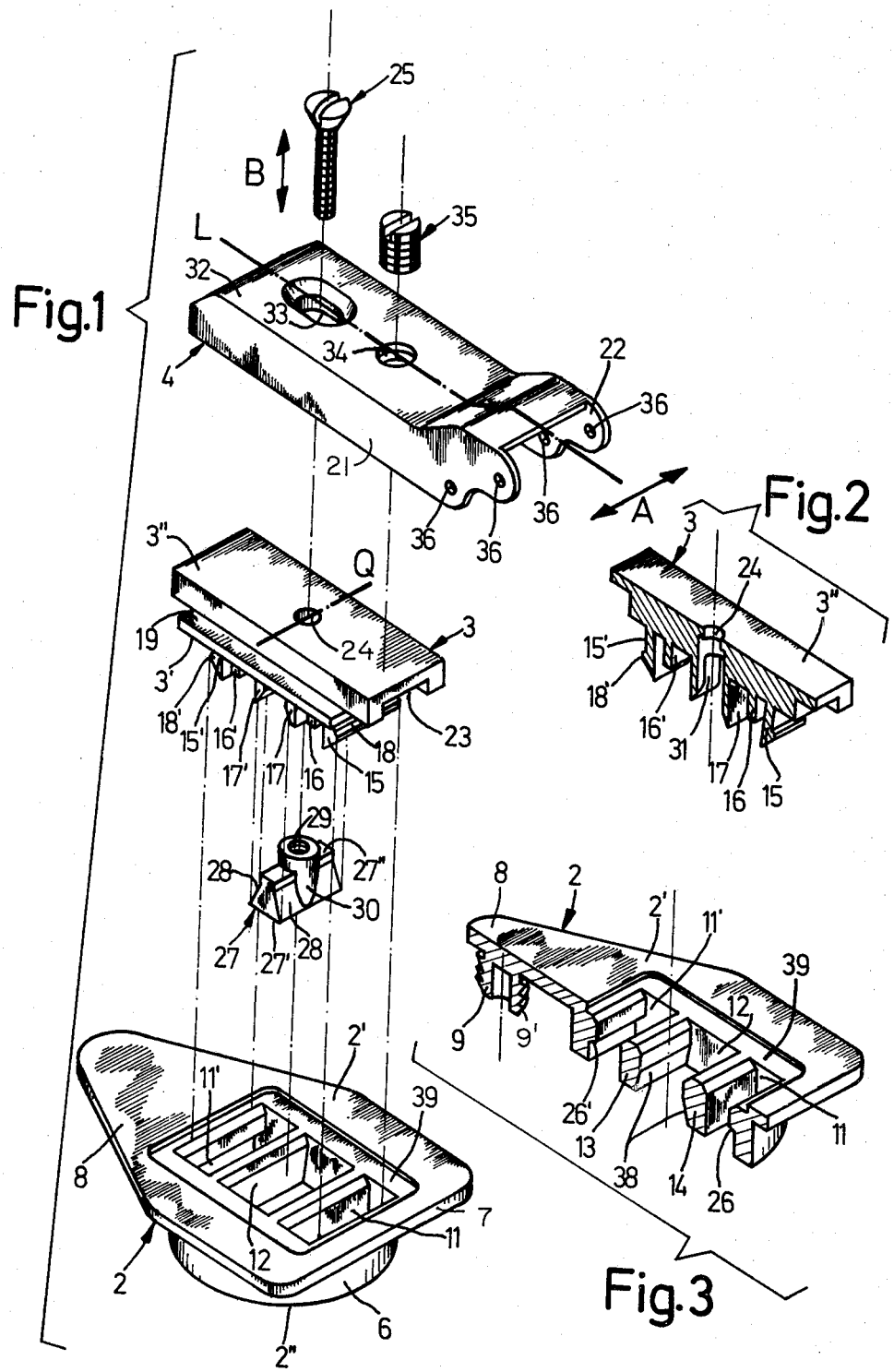
FIG. 1 a perspective exploded view of the hinge arm of a furniture hinge according to the invention, together with the base or adjusting plate consisting of the anchoring part and the intermediate support.
FIG. 2 a perspective view of the intermediate support of the base or adjusting plate according to FIG. 1, longitudinal cross section.
FIG. 3 a perspective view of the anchoring part of the base or adjusting plate according to FIG. 1, longitudinal cross section.
Figure 4:
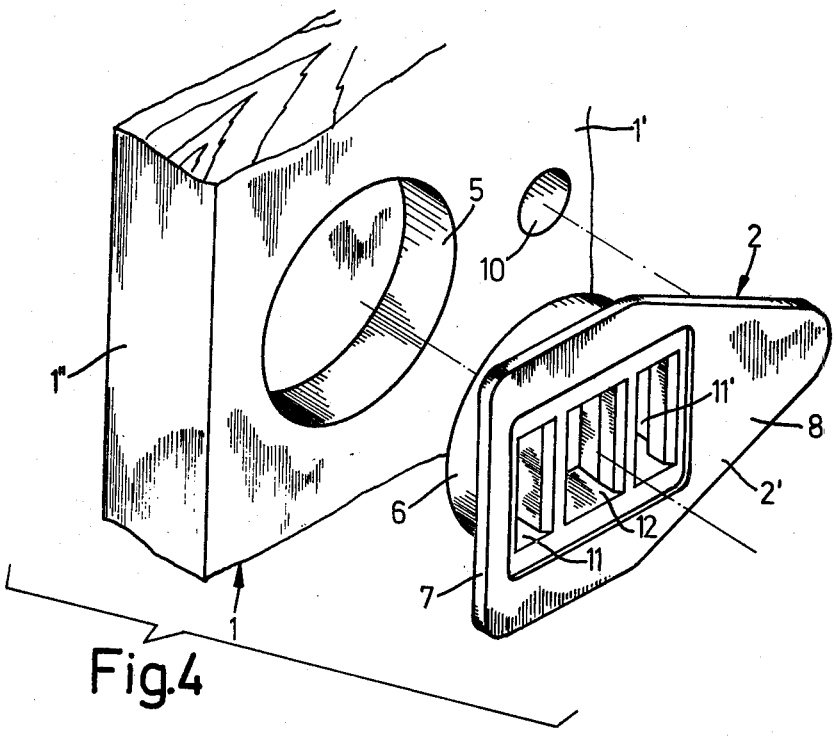
FIG. 4 a perspective view of a part of a furniture side wall and of the anchoring part before insertion into the fastening bore in the furniture side wall.

The furniture side wall is designated in the figures with 1. A hinge arm 4 of the furniture hinge which is not described in detail is fastened to the side wall 1. This hinge arm 4 is held on the furniture side wall by means of a base or adjusting plate consisting of an anchoring part 2 and an intermediate support 3. The anchoring part 2 has a cup shape and it is inserted, for fastening on the furniture side wall, into a bore 5 provided on the inner surface 1 of this furniture side wall and it is there fastened by its cylindrical section 6 in a conventional manner, for example, by adhesive bonding, screws, by hooking ribs etc.

After the insertion into the bore 5 the cup shaped anchoring part 2 has on its visible end face 2' a flat plate shaped section 7, whose surface is parallel to the inner face 1' after it has been fastened into the furniture side wall. This plate shaped section 7 on this end face 2' forms an edge projecting sideways beyond the enclosing surface of the section 6. The plate shaped section 7 has, in the embodiment shown, basically a square plan view and it has on one side a triangular projection 8 which projects sideways outwards from the section 6. This triangular projection carries, on its side facing the furniture side wall 1, an additional fastening plug 9, which engages with a second bore 10 of smaller diameter on the inner surface 1' of the furniture wall 1. The bores 5 and 10 are made preferably as blind bores, i.e. they are open only on the inner surface 1'. The fastening plug 9 has on its external circumference several hooking ribs 9', which are used for anchoring this fastening plug into the hole 10. The holes 5 and 10 are arranged so that the line connecting them is parallel to the longitudinal axis L of the hinge 4 and at right angles to the end face 1' of the furniture side wall 1, in which the hole 5 is situated closer to the said end face than the hole 10.

The anchoring part 2 has on the end face 2' three openings 11, 11' and 12 which have a rectangular cross section and whose longitudinal axes are parallel to the end face 1'' of this furniture side wall or which project along the axis indicated by a double arrow A when the anchoring part 2 is fixed into the furniture side wall 1. The openings 11, 11' and 12, which have equal lengths viewed in the direction of the double arrow A, are arranged in such a manner that the opening 12 is situated between the openings 11 and 11' in which all the openings 11, 11' and 12 project into the cylindrical section 6 and which are separated from each other by walls or wall sections 13 and 14.

The intermediate support 3 is shown in the embodiment represented, as a flat plate shaped part with rectangular plan view and it has on its underside 3' facing the anchoring part 2, when the hinge arm is fastened, six flexible wall sections, 15, 16, 17, 15', 16' and 17' which project away from this underside and which project along the axis indicated by the double arrow A; the lengths of these wall sections are shorter in the direction of the double arrow A than the corresponding lengths of the openings 11, 11' and 12. The wall sections which are parallel to each other are arranged on the underside 3' of the intermediate support 3 in such a manner that, starting from one end face of this intermediate support which is adjacent to the end face 1'' when the hinge is fastened on the furniture wall, the wall section 15 follows the wall section 16, the wall section 16 follows the wall section 17, the wall section 17 follows the wall section 17', the wall section 17' follows the wall section 16' and the wall section 16' follows the wall section 15'. The sections 15 and 15' are provided additionally with ratchet noses 18 or 18', which project towards the adjacent end faces of the intermediate support 3, sideways away from the wall section and they are pointed over the whole width or length of the wall sections 15 and 15' in the direction of the double arrow A.

The intermediate support 3 has in the region of its underside 3', on both its longitudinal sides, a sideways projecting edge 19, whose top face is used as a mounting face for the hinge arm 4 with U shaped cross section or for the webs 21 and 22 of this hinge arm. Each end face of the intermediate support 3 is finally provided with an opening 23 which is open towards the underside 3' as well as towards the said end face, this opening 23 is provided for facilitating separation between the anchoring part 2 and the intermediate support 3, as described below in detail.

As shown by the figures the intermediate support 3 is symmetrical to a transverse axis Q which is at right angles to the longitudinal axis L and which projects in the direction of the double arrow A. At the intersection of this transverse axis Q and the longitudinal axis L a bore 24 is provided for insertion of a clamping or fastening screw 25. The wall sections 15, 15', 16, 16', 17, 17' are arranged in space in such a manner that when the intermediate support 3 is placed on the anchoring part 2 or on the end face 2' of the said anchoring part, then the wall sections 15 and 16 project into the opening 11, the wall sections 17 and 17' project into the opening 12 and the wall sections 15' and 16' project into the opening 11'. The wall sections which are in this manner arranged in pairs into one given opening are in contact with the longitudinal sides of the given openings by the end faces which face away from each other and the ratchet nose 18 contacts a ratchet step 26 of the longitudinal side of the opening 11 adjacent to the end face 1'' of the furniture side wall 1 and the ratchet nose 18' contacts the ratchet step 26' on the longitudinal side of opening 11 facing away from the end face 11''.

An expanding element 27, fitted between the wall sections 17 and 17', has wedge shaped sloping sides on its longitudinal sides 28 projecting in the direction of the double arrow A, so that this expanding element 27 becomes narrower from the underside 27 up to the narrow top end 27''. The top end 27'' has a tapped hole 29 for fastening screw 25. The said expanding element is reinforced in the region of the tapped hole 29 by a sleeve shaped section 30 forming an integral part of this expanding element. Part circular openings 31, or 31' on the wall sections 17 or 17' match the sleeve shaped section 30. These openings form guides for the expanding element 27 in the direction of the axis of the fastening screw 25 or in the direction of the double arrow B.

The yoke 32 connecting the webs 21 and 22 of the hinge arm has an elongated hole 33 for the fastening screw 25 which projects in the direction of the longitudinal axis L and it has a tapped hole 34 for an adjusting screw 35. Elongated hole 33 permits adjustment of hinge arm 4 along longitudinal axis L during assembly.

The webs 21 and 22 of the hinge arm 4 have at one end region two bearing holes 36, in which the said bearing holes 36 are used for the hinge pivot axes which are not described in detail and which project in the direction of the double arrow A. The other end of the hinge arm 4 has a curved part 37, by means of which the hinge arm 4 rests on the top face 3'' of the intermediate support 3.

Figure 5:
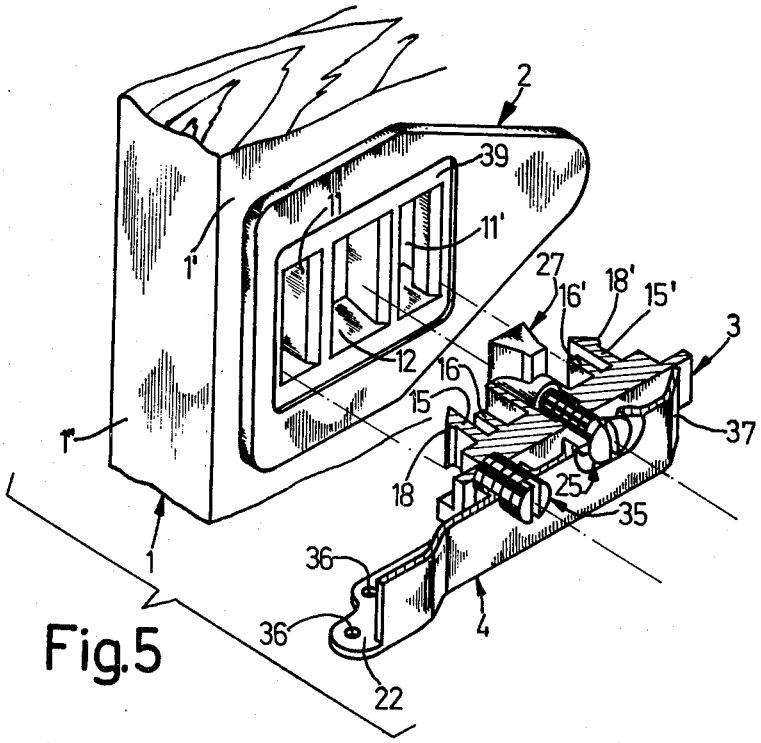
FIG. 5 a perspective view of the furniture side wall and of the anchoring part fastened on the furniture side wall together with the hinge arm and the intermediate support fastened on the hinge arm, the intermediate support is removed from the anchoring part; this view shows a longitudinal cross section of the intermediate support and of the hinge arm.
Figure 6:
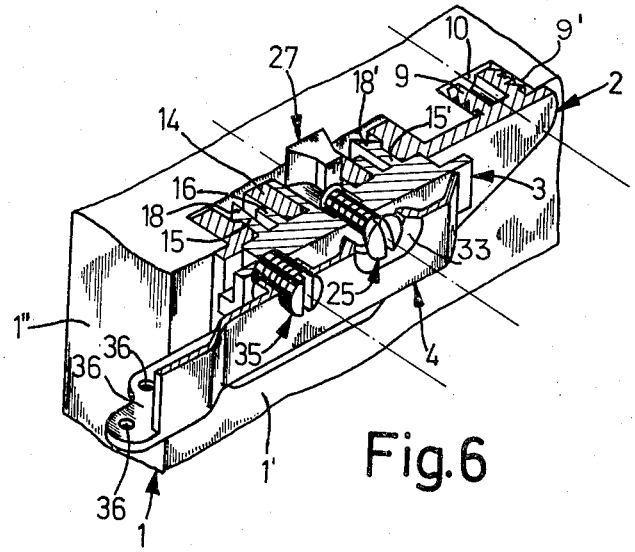
FIG. 6 a perspective view of a cross section through the furniture side wall, through the anchoring part, through the intermediate support and through the hinge arm, the components being fastened on the furniture side wall.
Figure 7:
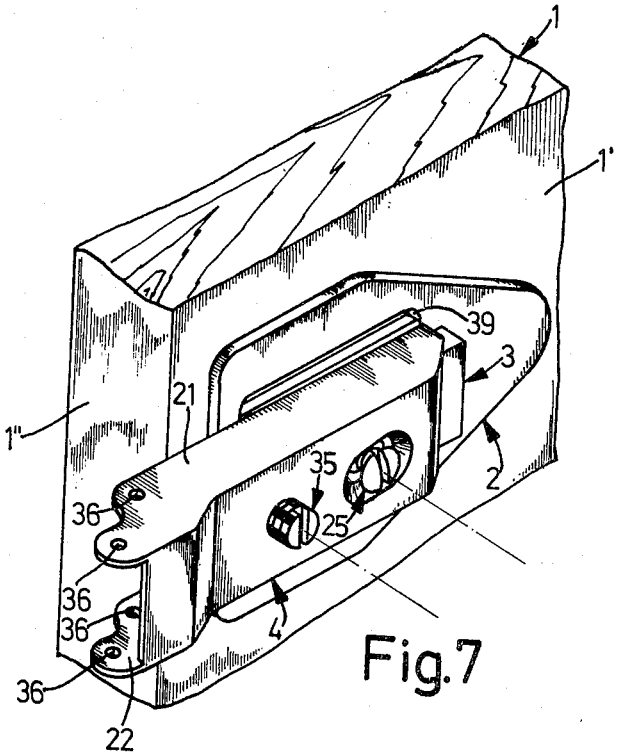
FIG. 7 a perspective view similar to that in FIG. 6 but in which the components are not sectioned.

The hinge arm 4 is fitted on the furniture side wall 1 so that at first the anchoring part 2 is fastened into bores 5 and 10. The anchoring part 2 is arranged after this fastening so that the longitudinal sides of the openings 11, 11' and 12 are parallel to the end face 1'' of the furniture side wall 1. The hinge arm 4, preassembled with the adjusting screw 35, is now placed on the intermediate support 3, in which the said intermediate support is enclosed on its longitudinal sides by the webs 21 and 22 of the hinge arm 4 so that the intermediate support cannot rotate. The fastening screw 25 is placed through the elongated hole 33 and screwed through the bore 24 into the tapped hole 29 of the expanding element 27. The expanding element 27 as shown in FIG. 5 is situated between the wall sections 17 and 17', but without pushing these wall sections sideways.

Subsequently the intermediate support preassembled with the hinge arm 4 is placed on the end face 2' of the anchoring part 2 in such a manner that the wall sections 15, 15', 16, 16', 17 and 17' engage in the previously described manner with the openings 11, 11' and 12, in which the ratchet noses 18 and 18' are locked behind the steps 26 and 26', so that for the intermediate support 3 as well as for the hinge arm 4 a certain clamping effect is already ensured on the anchoring part 2.

Since, as described above, the intermediate support 3 is symmetrical to the transverse axis Q, it is therefore not necessary, on connecting the intermediate support(s) 3 with the hinge arm 4, to pay attention to the rotational orientation of the intermediate support 3 between the webs 21 and 22. The intermediate support 3 can be fastened equally well into the position shown in the figure as well as into a position rotated through 180° about the axis of the fastening screw 25 on the hinge arm 4. This significantly simplifies the assembly of the intermediate support 3 and hinge arm 4.

Figure 9:
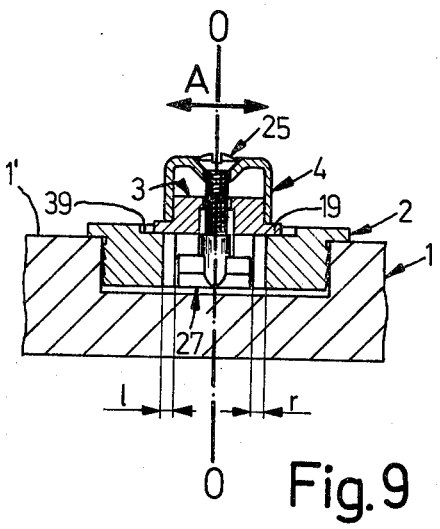
FIG. 9 section along 9—9 in FIG. 8.
Figure 8:
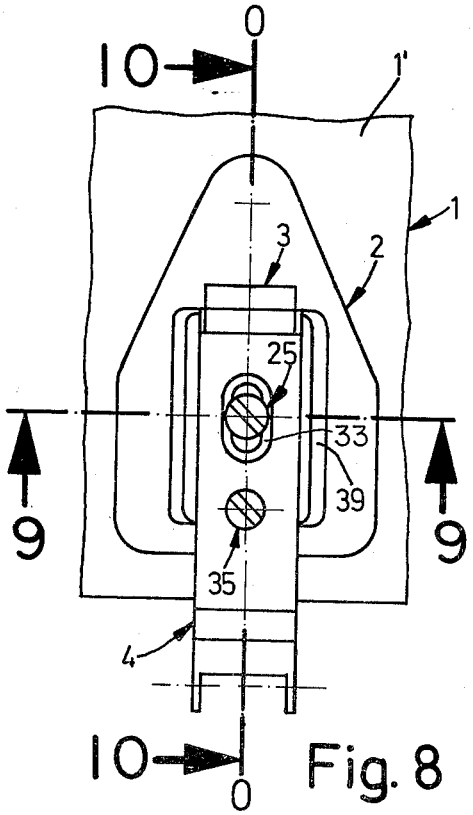
FIG. 8 plan view of the hinge arm fastened on the furniture side wall.

Since, as shown especially by FIG. 9, the lengths of the wall sections 15, 15', 16, 16', 17 and 17' are less in the direction of the double arrow A than the lengths of the openings 11, 11' and 12 in the said direction, it is therefore possible, after the ratchet noses 18 and 18' are engaged with the steps 26 and 26', to slide the intermediate support 3 as well as the hinge arm 4 relative to the anchoring part 2 or relative to the furniture side wall 1 in the direction of the arrow A in order to compensate tolerances in each direction. In the FIG. 9, which shows the intermediate support 3 or the hinge arm 4 in the middle position or in the neutral position, the maximum displacement away from this middle position is indicated in the direction of the double arrow A to the right or to the left with r or with l.

In addition to the adjustment of the hinge arm 4 in the direction of the double arrow A, i.e. in the direction of the hinge axis of the hinge or in a direction parallel to the end face 1'' the hinge shown makes it possible also to adjust the hinge arm 4 in the longitudinal direction, i.e. in the direction of the longitudinal axis L and it is possible to carry out adjustment by means of the adjusting screw 35 in the direction of the double arrow B, i.e. in the direction at right angles to the inner surface 1' of the furniture side wall 1.

After the hinge arm 4 has been aligned along all three coordinate axes in space according to double arrows A and B as well as along the longitudinal axis L relative to the furniture side wall 1, then the fastening screw 25 is tightened. The previously straight wall sections 17 and 17' (FIG. 10) are pressed sideways by the wedge shaped expanding element 27 in the region of the lower ends and against the sloping clamping faces 38 on the longitudinal sides of the opening 12. The clamping faces 38 are oriented so that the opening diverges from the end face 2' towards the underside 2'' of the anchoring part 2. When the fastening screw 25 is tightened, the hinge arm 4 is pressed by the free end of the curved part 37 as well as by the lower end of the adjusting screw 35 against the upper face 3'' of the intermediate support 3. The free end is slightly pressed into the elastic material of the upper face of the intermediate support 3. This prevents undesirable sliding of the hinge arm 2 in the direction of the longitudinal axis L. Hence a single fastening screw 25 connects all components of the hinge (hinge arm 4, intermediate support 3 and anchoring part 2) together.

In order to additionally ensure a guiding movement for the wall sections 15, 15', 16, 16', 17 and 17' between the intermediate support 3 and the anchoring part 2, the anchoring part 2 is provided at its end face 2', in the region of the openings 11, 11' and 12, with a depression 39. The intermediate support 3 projects partly into this depression 39 as shown for example in FIG. 9. This figure also shows that the edge 19 which projects sideways from the longitudinal side of the intermediate support 3 has such a width that the openings 11, 11' and 12 are always covered, when the intermediate support 3 is moved in the direction of the double arrow A, by these edges 19 on the end face 2', which is desirable from the appearance point of view as well as for avoiding collection of dirt in the openings 11, 11' and 12.

Figure 10:
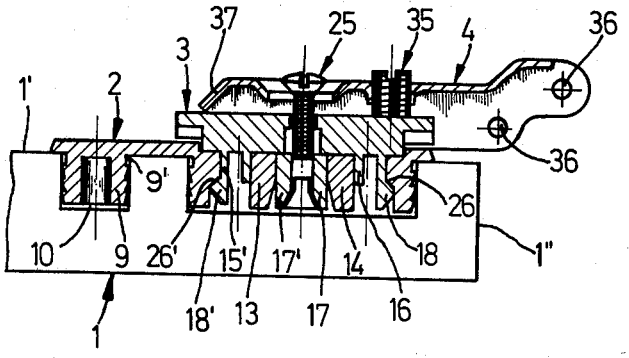
FIG. 10 section along 10—10 in FIG. 8 in which the clamping screw is not completely tightened.
Figure 11:
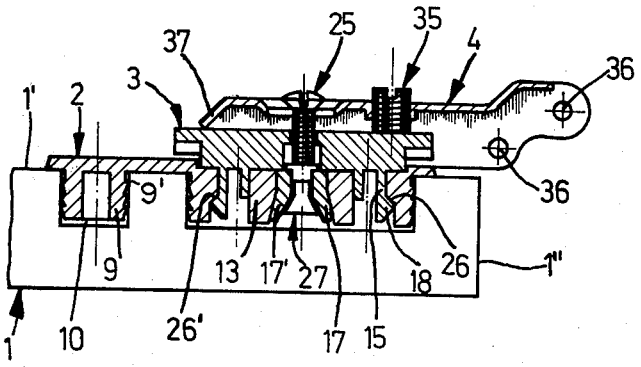
FIG. 11 section 10—10 in FIG. 8 when the clamping screw is fully tightened.

If the hinge arm is for any reason to be detached again from the anchoring part 2, then first the fastening screw 25 is released. On applying external pressure on this fastening screw, the expanding element 27 is pushed out of the space between the wall sections 17 and 17' to such an extent that these wall sections assume once again the straight line position as shown in FIG. 10. On inserting a suitable tool, for example a screwdriver, into the opening 23 and on rotating the screwdriver, supported at the same time on the end face 2', it is possible to release the intermediate support 3 from its anchoring on the anchoring part 2. Release is possible because the steps 26 and 26' have sloping faces which are inclined towards the middle of said intermediate support and they have also ratchet noses 18 and 18' with corresponding ratchet steps. The design of the steps 26 and 26' or of the ratchet noses 18 or 18' makes it possible to hold the intermediate support 3, up to the final tightening of the fastening screw 25, on the anchoring part 2. Also this embodiment makes it possible to detach the intermediate support 3 from the anchoring part 2.

The intermediate support 3 is made preferably as an integral unit from an elastic material, for example, from elastic or flexible plastic material. For example, plastic material is also suitable for making of the anchoring part and it is suitable also for making the expanding element 27.

The hinge arm 4 is made preferably from metal, for example from sheet metal by bending and pressing operations.

The invention was described above by means of an embodiment example. It is to be understood that variations of the above are possible without departing from the principle of the invention.

What is claimed is:

1. A hinge member for attachment into at least one bore in a panel, said hinge member having at least one axis pivot comprising:

(a) an anchoring part for insertion into said at least one bore and having means for holding said anchoring part in said at least one bore;

(b) an intermediate support;

(c) at least one flexible ratchet member on one of said intermediate support and said anchoring part and engageable with the other thereof for cooperatively connecting said anchoring part and said intermediate support together;

(d) a hinge arm;

(e) fastening means for connecting said hinge arm and said intermediate support to said anchoring part;

(f) first adjustment means for permitting displacement adjustment of said hinge arm with respect to said panel in a first direction parallel to said panel; and (g) said fastening means including walls in said anchoring part defining at least one opening therein, said fastening means further including at least two opposed flexible wall sections on said intermediate support fitting into said at least one opening, and clamping means for expanding said opposed flexible wall sections against said walls.

2. The hinge member recited in claim 1, further comprising second adjustment means for permitting displacement adjustment of said hinge arm with respect to said panel in a second direction parallel to said panel, said second direction being different from said first direction.

3. The hinge member recited in claim 1 or 2, further comprising third adjustment means for permitting adjustment of said hinge arm toward and away from said panel.

4. The hinge member recited in claim 1, wherein said at least one opening in said anchoring part is a generally rectangular opening extending in the first direction, and wherein said at least two opposed flexible wall sections being less wide than said rectangular opening, and said rectangular opening and said at least two opposed flexible wall sections forming said first adjustment means.

5. The hinge member recited in claim 4, further comprising:

(a) a ratchet step in at least one wall of said rectangular opening; and (b) a ratchet nose on at least one of said two opposed flexible wall sections, said ratchet nose mating with said ratchet step whereby said intermediate support is retained in said anchoring part said ratchet nose and said ratchet step comprising said flexible ratchet member.

6. The hinge member recited in claim 5, further comprising engaging faces on said ratchet step and said ratchet member, said engaging faces being inclined to permit disengagement thereof.

7. The hinge member recited in claim 4, further comprising:

(a) at least a second generally rectangular opening in said anchoring part;

(b) at least a third flexible wall section on said intermediate support fitting into said second rectangular opening and being less wide than said second rectangular opening;

(c) a ratchet step in one wall of said second rectangular opening; and (d) a ratchet nose on said at least a third flexible wall section, said ratchet nose mating with said ratchet step of said second rectangular opening and said at least a third flexible wall section with said ratchet nose forming said flexible ratchet member.

8. The hinge member recited in claim 7, further comprising:

(a) at least a third generally rectangular opening in said anchoring part;

(b) at least a fourth flexible wall section of said intermediate support fitting into said third rectangular opening and being less wide than said third rectangular opening;

(c) a ratchet step in one wall of said third rectangular opening; and (d) a ratchet nose on said fourth flexible wall section forming said flexible ratchet member, said ratchet nose mating with said ratchet step of said third rectangular opening.

9. The hinge member recited in claim 8, wherein said at least two opposed flexible wall sections are positioned between said third and fourth flexible wall sections.

10. The hinge member recited in claim 1, wherein said clamping means comprises:

(a) a hole through said intermediate support normal to said panel, said hole passing between said at least two opposed flexible wall sections;

(b) a hole in said hinge arm;

(c) a wedge shaped expanding element;

(d) a screw passing through said hole in said hinge arm and threadably engaging said expanding element;

(e) said wedge shaped expanding element fitting between said two opposed flexible wall sections and urging them outward into clamping contact with said walls; and (f) said screw fastening said hinge arm to said intermediate support and fastening said intermediate support to said anchoring part.

11. The hinge member recited in claim 10, further comprising clamping face means on said walls for holding said opposed flexible wall sections.

12. The hinge member recited in claim 10, further comprising:

(a) a sleeve shaped section on said expanding element; and (b) a part circular opening having an enlarged diameter and being concentric with said hole through said intermediate support, said sleeve shaped section fitting guidedly in said part circular opening even in the absence of said screw.

13. The hinge member recited in claim 10, wherein said hole in said hinge arm is elongated.

14. A hinge member for attachment into at least one bore in a panel, said hinge member having at least one pivot axis comprising:

(a) a cup shaped anchoring part having a cylindrical section attachably fitting into said at least one bore;

(b) a flat plate section on said cup shaped anchoring part;

(c) first, second and third rectangular holes having walls in a row in said flat plate section;

(d) first and second ratchet steps respectively in the walls of said first and third rectangular holes;

(e) an intermediate support;

(f) first and second flexible wall sections on said intermediate support fitting into said first and third rectangular holes;

(g) first and second ratchet noses respectively on said first and second flexible wall sections engageable with said first and second ratchet steps;

(h) third and fourth flexible wall sections on said intermediate support fitting into said second rectangular hole, when said first and second ratchet noses are engaged respectively with said first and second ratchet steps;

(i) the first, second, third and fourth flexible wall sections being less wide than the lengths of said first, second and third rectangular holes, whereby said intermediate support may be adjustably displaced in a first direction parallel to said flat plate section;

(j) a clamping hole in said intermediate support at right angles to said panel terminating between said third and fourth flexible wall sections;

(k) a hinge arm having an elongated hole wherein, aid hinge arm being fitted to said intermediate support with said elongated hole aligned with said clamping hole, said elongated hole permitting adjustable displacement of said hinge arm in a second direction at right angles to said first direction;

(l) a wedge shaped expanding element having a threaded hole wherein, said wedge fitting between said third and fourth flexible wall sections;

(m) a clamping screw passing through said elongated hole, said clamping screw being threadably engaged with said threaded hole; and (n) said clamping screw and expanding element being effective to expand said third and fourth flexible wall sections clampingly against opposed walls of said second rectangular hole whereby said intermediate support is fastened to said anchoring part and said hinge arm is fastened to said intermediate support.

15. The hinge recited in claim claim 14, further comprising:

(a) fifth and sixth wall sections on said intermediate support between and parallel to said first and second flexible wall sections;

(b) said fifth and sixth wall sections fitting guidingly in said first and third rectangular holes; and (c) said third and fourth flexible wall sections being arranged between and parallel to said fifth and sixth wall sections.

* * * * *